US005359755A

United States Patent [19]

Dalton et al.

[11] Patent Number: 5,359,755

[45] Date of Patent: Nov. 1, 1994

[54] GARMENT SECURITY CLIP

[75] Inventors: Paul W. Dalton, Coventry; David A. Cooper, Market Drayton, both of England

[73] Assignee: Volumatic Ltd., Coventry, England

[21] Appl. No.: 958,292

[22] Filed: Oct. 8, 1992

[51] Int. Cl.[5] ..... A44B 21/00

[52] U.S. Cl. ..... 24/515; 24/537; 200/61.58 R

[58] Field of Search ..... 24/DIG. 22, 515, 537, 24/503; 200/61.42, 61.58 R, DIG. 10

[56] References Cited

U.S. PATENT DOCUMENTS

| | | | |
|---|---|---|---|
| 685,974 | 11/1901 | Cote | 24/DIG. 22 X |
| 848,584 | 3/1907 | Albin et al. | 24/537 |
| 4,616,113 | 10/1986 | Jank et al. . | |

FOREIGN PATENT DOCUMENTS

| | | | |
|---|---|---|---|
| 144388 | 1/1936 | Austria | 24/515 |
| 0153658 | 2/1985 | European Pat. Off. . | |
| 2912008 | 10/1980 | Germany . | |
| 63791 | 2/1913 | Switzerland | 24/537 |
| 462432 | 3/1937 | United Kingdom | 24/515 |
| 582989 | 12/1946 | United Kingdom | 24/515 |
| 123444 | 1/1947 | United Kingdom | 24/537 |
| 2044096A | 10/1980 | United Kingdom . | |
| 2137276 | 10/1984 | United Kingdom . | |
| 2137276A | 10/1984 | United Kingdom . | |

*Primary Examiner*—James R. Brittain

*Attorney, Agent, or Firm*—Ware, Fressola, Van Der Sluys & Adolphson

[57] ABSTRACT

A garment security clip (10) has upper and lower jaws (11,12) and a slider (13) to restrain the jaws which are pivoted (at 14). In one form, an inwardly directed projection (18) snaps over spaced projecting ribs (19) along the lower jaw (12). Alternatively, ribs (30) on the top of the upper jaw (11) are engaged by a projection (31) inside the slider (13). A microswitch (21) mounted on the lower jaw is normally received within an aperture (20,27) of the upper jaw except where the aperture is covered by fabric which then operates the microswitch (21) which is connected to energize an alarm system.

3 Claims, 1 Drawing Sheet

GARMENT SECURITY CLIP

This invention relates to a garment security clip of a type which is non-permanently attached to the fabric of a garment and which is electrically connected to an alarm such that removal of the fabric from the clip operates the alarm.

In a conventional form, a garment security clip comprises a pair of relatively movable clamping jaws and restraining means adapted to limit the separation of the jaws, the restraining means being slidable relative to the jaws between free and restraining positions. The jaws have face members adapted to contact each other in a clamped condition, one face member including an aperture means and the other face member including switch means aligned with the aperture means so that, in the clamped condition, the switch means is not normally operated by clamping together of the jaws except when a layer of fabric overlies and effectively closes the aperture means.

Such a garment security clip will be referred to as "a garment security clip of the type described".

Presently, garment security clips of the type described have two problems. Firstly, it is difficult to retain the clips securely while accommodating a range of thicknesses of fabric from for example the heavy wool cloth or quilted material of an overcoat to thin silk or cotton cloth. Secondly, the clip tends to distort the fabric as the jaws are clamped. While this is not a problem with most fabrics, the fabric can be marked if for example it is a loosely woven lightweight cloth or if the fabric of the garment is leather.

It is an object of the present invention to provide a new or improved garment security clip of the type described which overcomes or reduces these disadvantages.

According to the invention there is provided a garment security clip comprising a pair of relatively movable clamping jaws, restraining means adapted to limit the separation of the jaws and slidable relative to the jaws between free and restraining positions, the jaws having face members adapted to contact each other in a clamped condition, one face member including an aperture means and the other face member including switch means aligned with the aperture means so that, in the clamped condition, the switch means is not normally operated by clamping together of the jaws except when a layer of fabric overlies and effectively closes the aperture means, and wherein detent means are provided for the slidable restraining means at spaced positions between the free and restraining positions thereof.

The detent means preferably comprise a plurality of ribs provided externally of one or both jaws and engageable by a projection on said restraining means.

The restraining means may comprise a sleeve slidably mounted on the jaws and the projection may be provided internally of the sleeve. Preferably, the sleeve projection snap engages the plurality of ribs as the restraining means is moved along the jaws.

The jaws may have a pair of generally parallel faces. The parallel faces may be provided with a guide formation engageable by a guide formation provided internally of the sleeve.

The face members of the jaws may be detachable and replaceable.

The face members may comprise, in a first form, a generally frusto-conical boss on one face member and a generally frusto-conical recess on the other face member, the frusto-conical boss having said aperture means provided centrally therein and the frusto-conical recess having switch means therein.

In an alternative form, said one face member may comprise an apertured disc and said other face member may have switch means therein.

Embodiments of the invention will now be described in more detail by way of example only with reference to the accompanying drawings in which FIG. 1 a longitudinal sectional view of a first embodiment of a garment security clip.

Figure 1:
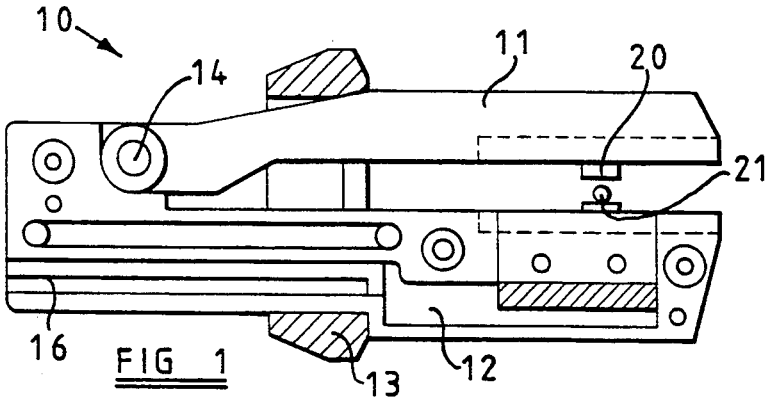
Figure 2:
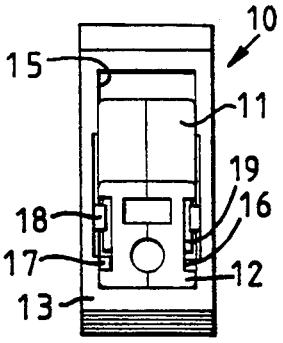
FIG. 2 is an end elevational view of the clip of FIG. 1.
Figure 3:
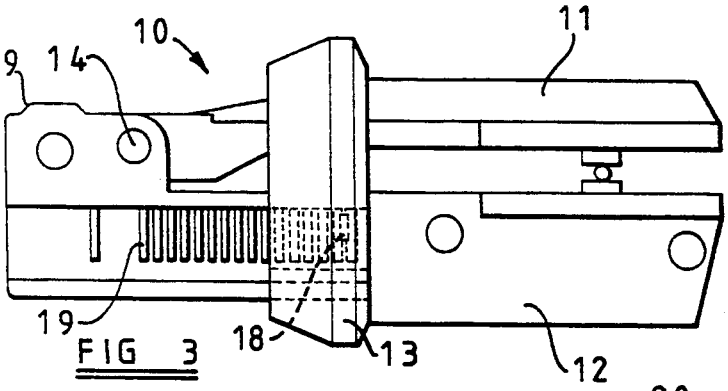
FIG. 3 is a side elevational view of the clip of FIG. 1.
Figure 4:
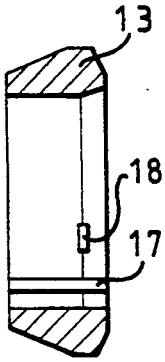
FIG. 4 is a vertical sectional view of a restraining means of the clip of FIGS. 1 to 3.

Referring firstly to FIGS. 1 to 4 of the drawings, a garment security clip generally indicated at 10 comprises an upper jaw 11, a lower jaw 12 and a slider 13 which acts as a restraining means for the jaws 11 and 12. The jaws 11 and 12 are pivoted at 14 although they could have some other form of linkage permitting relative movement.

The jaws 11, 12 have a pair of generally parallel upright side faces as shown in the drawings, permitting the slider 13 to slide along with its internal aperture walls 15 closely conforming to the side walls. An undercut 16 on the lower jaw 12 receives a corresponding projection 17 on the slider 13 to guide it longitudinally. The formation 9 ensures that the slider is correctly aligned to the mating forms of the body components during assembly.

The slider 13 also includes an inwardly directed projection 18 which is arranged to contact and snap over a plurality of projecting ribs 19 disposed at spaced positions along the lower jaw 12.

In the condition of the jaws shown in FIG. 1, the inner faces of the jaws are spaced and parallel. The upper jaw 11 has an abutment 20 which faces a microswitch 21 on the lower jaw. At this condition, the slider 13 can be slid fully to the right as viewed in the drawings.

Figure 5:
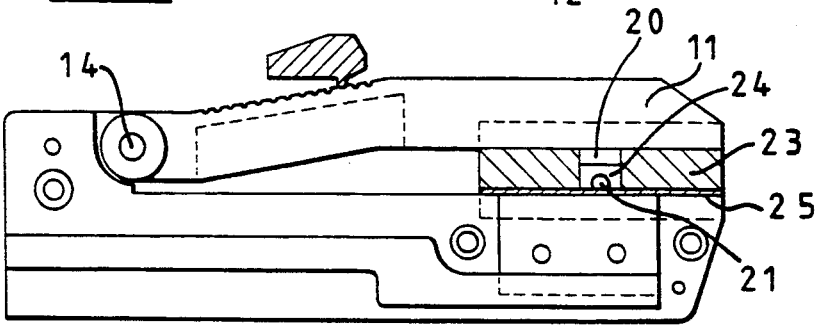
FIG. 5 is a side elevational view, partly in section, of a second embodiment of garment security clip illustrating first type face members.
Figure 6:
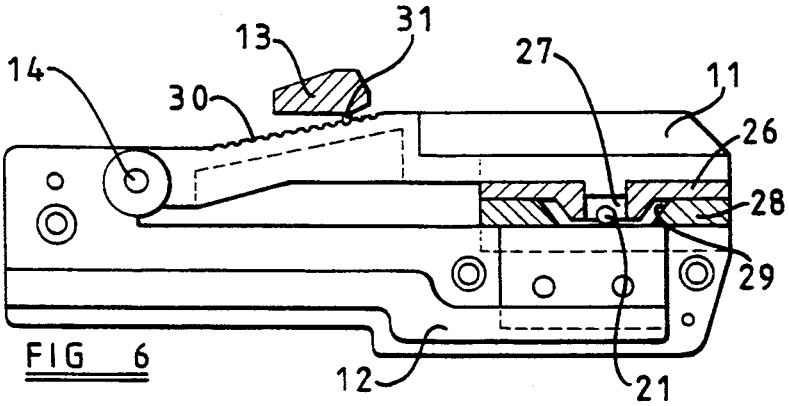
FIG. 6 is a view similar to FIG. 5 illustrating second type face members.

The jaws 11 and 12 are provided with face members, two examples of which are shown in FIGS. 5 and 6 respectively. In a first type shown in FIG. 5, an upper face member 23 comprises a thick disc of relatively soft material such as slightly resilient plastics. It includes a central aperture 24. A lower jaw 25 comprises a plate adapted to surround the microswitch 21. It will be seen that the face members 23, 25 in abutment normally prevent the microswitch 21 from contacting the abutment 20. However, when a piece of cloth is stretched over the face member 23 and clamped between the upper and lower jaws, the fabric itself contacts the microswitch 21, causing it to operate to energise an electrical alarm circuit. Removal of the cloth or opening of the jaws then causes the microswitch to revert to its first condition, triggering the alarm.

In FIG. 6 of the drawings, the face members are provided with cooperating frusto-conical formations. The upper jaw 11 has a face member 26 having a frusto-conical boss including a central aperture 27. The lower jaw 28 has a frusto-conical recess 29 within which the microswitch 21 is centrally positioned. The principle of operation is the same as described in relation to the first type of face members shown in FIG. 5.

FIGS. 5 and 6 also show an alternative positioning of the detent means for the retaining means or slider. In this case, the detent means comprise a plurality of ribs 30 on the top of the upper jaw 11, engageable by a projection 31 inside the upper portion of the slider.

It will be appreciated that, when the device is to be used as a garment security clip for a particular type of garment, the appropriate face members 23, 25 or 26, 28 are fitted. The first type 23, 25 shown in FIG. 5 is most suitable for material which can be easily damaged by indentation such as fine loosely woven fabrics or leather. More robust fabrics will allow the use of the second type of face member shown in FIG. 6.

Depending on the thickness of the garment fabric, the slider 13 is moved as far as possible to the right hand side, allowing the detent means to hold the slider in its final position. When the fabric is thick, the jaws 11 and 12 are pivoted slightly open and the slider cannot be pushed fully to the right hand side. For thin material, the jaws can be moved to a fully parallel condition as shown and the detent means can be overcome throughout the travel of the slider from left to right.

It will be seen that the jaws can therefore be firmly clamped onto the fabric irrespective of its thickness within the limits of the jaw movement without the danger of the slider slipping back along the jaws and releasing the clip accidentally. This will reduce the incidence of spurious alarms.

We claim:

1. A garment security clip comprising a pair of relatively movable clamping jaws, restraining means adapted to limit the separation of the jaws and slidable relative to the jaws between free and restraining positions, the jaws having face members adapted to contact each other in a clamped condition, one face member including an aperture means and the other face member including switch means aligned with the aperture means so that, in the clamped condition, the switch means is not normally operated by clamping together of the jaws except when a layer of fabric overlies and effectively closes the aperture means, said face members being detachable and replaceable and wherein detent means are provided for the slidable restraining means at spaced positions between the free and restraining positions thereof, wherein the detachable face members comprise one face member having a generally frusto-conical boss and another face member having a generally frusto-conical recess, the frusto-conical boss and recess being aligned to cooperate in use and the frusto-conical boss having said aperture means provided centrally therein and the frusto-conical recess having switch means therein.

2. A garment security clip comprising:

a pair of relatively movable clamping jaws; and restraining means adapted to limit the separation of the jaws and slidable relative to the jaws between a free position and a restraining position, the jaws having face members adapted to contact each other in a clamped condition, one face member including an aperture means and the other face member including switch means aligned with the aperture means so that, in the clamped condition, the switch means is not normally operated by clamping together of the jaws except when a layer of fabric overlies and effectively closes the aperture means, said face members being detachable and replaceable and wherein detent means are provided for the slidable restraining means at spaced positions between the free and restraining positions thereof, wherein the detachable face members further comprise on face member having an apertured disc providing the aperture means and another face member also having a plate from which the switch means project, the apertured disc and plate being aligned such that the switch means is surrounded by the apertured disc in use.

3. The garment security clip defined in claim 2, wherein the detent means further comprises a plurality of ribs provided externally on at least one of said jaws and the restraining means further comprises a sleeve, slidably mounted on the jaws, the sleeve having an internal projection for engaging the plurality of ribs.

* * * * *

UNITED STATES PATENT AND TRADEMARK OFFICE

CERTIFICATE OF CORRECTION

PATENT NO. : 5,359,755

DATED : Nov. 1, 1994

INVENTOR(S) : Paul W. Dalton, et al

It is certified that error appears in the above-indentified patent and that said Letters Patent is hereby corrected as shown below:

Column 4, line 32, "on face" should be --one face--

Signed and Sealed this

Seventh Day of March, 1995

*Attest:*

Bruce Lehman

BRUCE LEHMAN

*Attesting Officer*

*Commissioner of Patents and Trademarks*